US009812243B2

(12) United States Patent
White et al.

(10) Patent No.: US 9,812,243 B2
(45) Date of Patent: Nov. 7, 2017

(54) POWER CONVERTERS WITH IMMERSION COOLING

(71) Applicant: Hamilton Sundstrand Corporation, Charlotte, NC (US)

(72) Inventors: Adam M. White, Belvidere, IL (US); Mustansir Kheraluwala, Lake Zurich, IL (US); Frank Z. Feng, Loves Park, IL (US); Kris H. Campbell, Poplar Grove, IL (US); Charles Shepard, DeKalb, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 225 days.

(21) Appl. No.: 14/688,892

(22) Filed: Apr. 16, 2015

(65) Prior Publication Data

US 2016/0307685 A1 Oct. 20, 2016

(51) Int. Cl.

| | |
|---|---|
| ***H01F 27/10*** | (2006.01) |
| ***H01F 27/08*** | (2006.01) |
| ***H01F 27/18*** | (2006.01) |
| ***H01F 27/00*** | (2006.01) |
| ***H01F 27/28*** | (2006.01) |
| ***H01F 27/32*** | (2006.01) |

(52) U.S. Cl.
CPC ..... *H01F 27/18* (2013.01); *H01F 27/00* (2013.01); *H01F 27/2876* (2013.01); *H01F 27/325* (2013.01)

(58) Field of Classification Search
CPC ..... H01F 27/2876
USPC ..... 336/58, 60, 61
See application file for complete search history.

(56) References Cited

U.S. PATENT DOCUMENTS

| | | | | |
|---|---|---|---|---|
| 1,548,388 | A * | 8/1925 | Shackelton | H01F 19/04 336/199 |
| 2,875,263 | A * | 2/1959 | Narbutovskih | F28D 15/0266 165/104.25 |
| 2,961,476 | A | 11/1960 | Maslin et al. | |
| 4,173,746 | A | 11/1979 | Stubblefield et al. | |
| 2012/0234520 | A1 | 9/2012 | Pal et al. | |
| 2013/0257574 | A1* | 10/2013 | Downing | H01F 17/062 336/57 |

FOREIGN PATENT DOCUMENTS

| | | | |
|---|---|---|---|
| EP | 2648194 | A1 | 10/2013 |
| JP | 58070510 | A * | 4/1983 |

OTHER PUBLICATIONS

Enlglish abstract of JP58070510A.*
European Search Report from the European Patent Office dated Sep. 9, 2016 for Application No. EP16165666.

* cited by examiner

*Primary Examiner* — Ronald Hinson
(74) *Attorney, Agent, or Firm* — Locke Lord LLP; Scott D. Wofsy; Christopher J. Cillié

(57) ABSTRACT

A transformer assembly includes a housing with a sealed housing interior, a transformer disposed within the housing interior and having a core with windings wrapped about the core, and a condenser mounted to the housing. The condenser is in fluid communication with the housing interior. A surface of the windings bounds a coolant channel extending between the windings and the condenser to convey coolant of a first phase to the condenser and receive coolant of a second phase from the condenser.

15 Claims, 4 Drawing Sheets

POWER CONVERTERS WITH IMMERSION COOLING

BACKGROUND OF THE INVENTION

1. Field of the Invention

The present disclosure relates to power conversion, and more particularly to cooling power converters that convert electrical power from one frequency and amplitude to another frequency and/or amplitude.

2. Description of Related Art

Power system architectures commonly employ power converters to convert one type of electrical power into another type of electrical power. In some power system architectures, such as in aircraft power distribution systems, rectifier circuits are employed to convert alternating current power into direct current (i.e. constant frequency) power. In some power system architectures, a transformer may be paired with the rectifier circuit, in which case the rectifier and transformer assembly is referred to as a transformer rectifier unit. If the transformer is a non-isolating type, then the transformer rectifier unit is generally referred to an autotransformer rectifier unit (ATRU). Such devices commonly include overlapping layers of electrically conductive windings that carry electrical current. As the electrical current flows through the overlapping windings, the current resistively heats the windings. Heat from the inner windings is typically removed by conduction through the outer windings prior to rejection to the external environment. The thermal resistance posed by the outer layers generally influences the rate of heat removal and temperature of the inner windings. In some applications, the thermal resistance of the outer windings can influence the power rating of the ATRU.

Such conventional methods and systems for cooling transformers have generally been considered satisfactory for their intended purpose. However, there is still a need in the art for transformers with improved cooling. The present disclosure provides a solution for this need.

SUMMARY OF THE INVENTION

A transformer assembly includes a housing with a sealed housing interior, a transformer disposed within the housing interior and having a magnetic core with windings wrapped about the core, and a condenser mounted to the housing. The condenser is in fluid communication with the housing interior. A surface of the windings bounds a coolant channel extending between the windings and the condenser to convey coolant of a first phase to the condenser and receive coolant of a second phase from the condenser.

In certain embodiments, the transformer can be an autotransformer or an autotransformer-rectifier unit. The core can define a vertically extending slot opposite a core-facing winding surface that bounds the coolant channel. The coolant channel can be bounded by a housing-facing surface of the winding and interior surface of housing. The winding can be an inner winding and an outer winding can be wrapped about the inner winding. The outer surface of the outer winding can bound the coolant channel. It is contemplated that a slotted bobbin can be disposed between the core and the windings, and slots defined within the bobbin can bound the coolant channel.

In accordance with certain embodiments, coolant can be disposed within the housing interior. The coolant can be a liquid, a gas, or a mixture of gas and liquid. The coolant can have a boiling temperature that corresponds to a predetermined maximum operating temperature of the windings. For example, the windings can have a maximum operating temperature that is greater than 56 degrees Celsius and the coolant can have a vaporization (boiling) temperature of about 56 degrees Celsius at a pressure of 1 atmosphere. The coolant can be a dielectric fluid containing a fluorocarbon like perfluorohexane or tetradecafluorohexane.

It is also contemplated that, in accordance with certain embodiments, the coolant can be predominately disposed as a coolant reservoir within the housing interior. The windings (and the transformer) can be immersed within the coolant reservoir. An ullage space can be defined between the surface of the coolant reservoir and a surface of the condenser facing the coolant reservoir. The condenser can be disposed on a side of the ullage space opposite the coolant reservoir, e.g. relative to gravity. The condenser can include a base and fins. The condenser base can form a portion of the housing. The condenser fins can extend from the base, through the ullage space, and into the coolant reservoir. It is also contemplated that the fins can include pins fins that define a lateral channel extending across the ullage space and above the windings to distribute evaporated coolant across the condenser.

A transformer assembly includes a housing with a sealed interior, a transformer disposed within the housing interior, and a condenser mounted to the housing and in fluid communication with the housing interior. The transformer can include a slotted bobbin, inner windings wrapped about the slotted bobbin, and outer windings wrapped about the inner windings. A bobbin-facing surface of the inner windings and bobbin slot bound a first coolant channel extending between a side of the transformer opposite the condenser and the condenser. A housing-facing surface of the outer windings and interior surface of the housing can bound a second coolant channel extending between the side of the transformer opposite the condenser and the condenser.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE PREFERRED EMBODIMENTS

Figure 1:
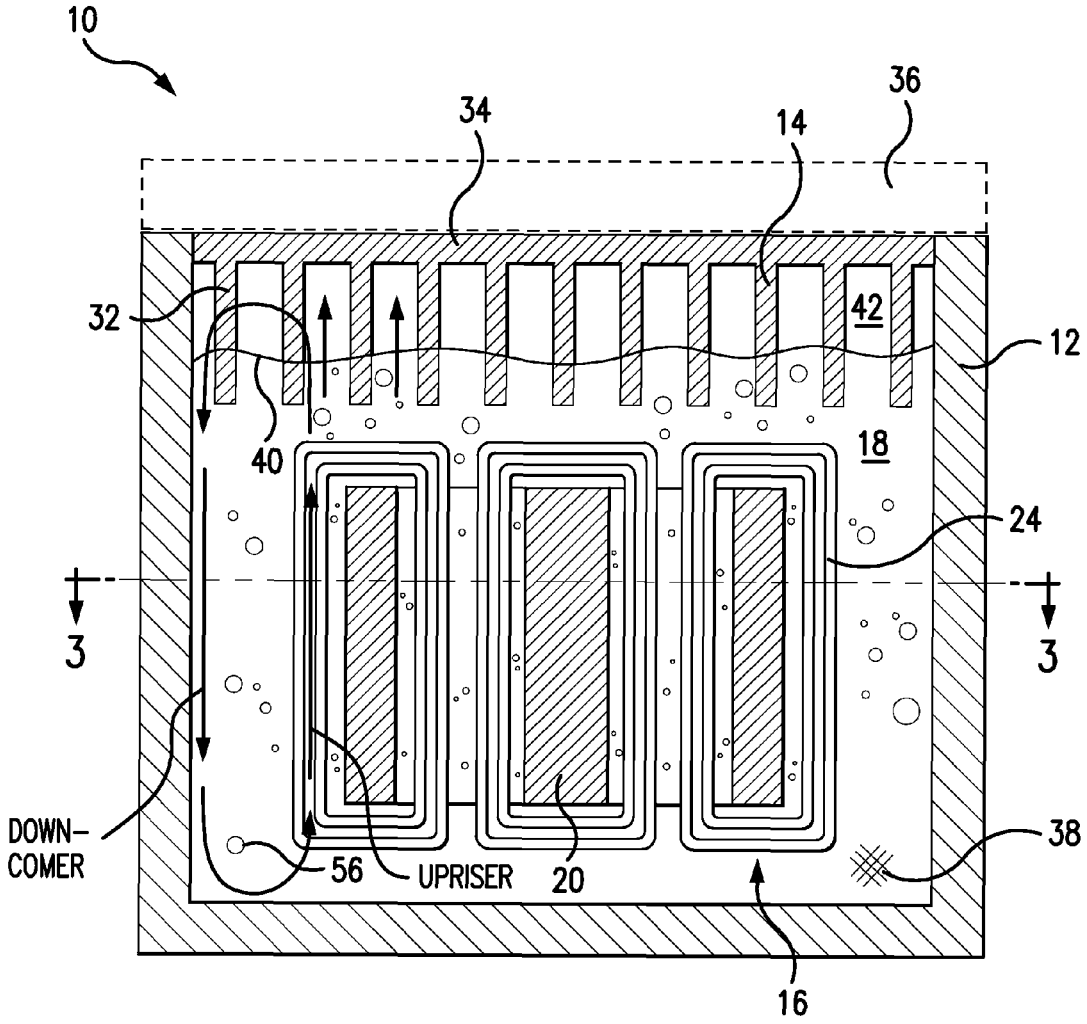
FIG. 1 is a schematic cross-sectional side elevation view of an exemplary embodiment of a transformer assembly constructed in accordance with the present disclosure, showing a transformer housed within a pressure vessel and immersed within a dielectric coolant.

Reference will now be made to the drawings wherein like reference numerals identify similar structural features or aspects of the subject disclosure. For purposes of explanation and illustration, and not limitation, a partial view of an exemplary embodiment of a transformer assembly in accordance with the disclosure is shown in FIG. 1 and is designated generally by reference character 10. Other embodiments of transformer assemblies in accordance with the disclosure, or aspects thereof, are provided in FIGS. 2-4, as will be described. The systems and methods described herein can be used to cool autotransformers, such as power supplies for motors in aircraft electrical systems.

With reference to FIG. 1, transformer assembly 10 is shown. Transformer assembly 10 includes a housing 12, a condenser 14, and a transformer 16. Housing 12 has a housing interior 18 and is sealable such that a pressure differential may be maintained between housing interior 18 and the environment external to transformer assembly 10. Transformer 16 is fixed within housing interior 18. Condenser 14 is fixed to housing 12 and is in fluid communication with housing interior 18.

Housing 12 fluidly isolates housing interior 18 from the environment external to housing 12. Housing 12 may additionally include one or more fluidly sealed penetrations extending through housing for connecting transformer 16 between a power source (not shown for clarity purposes) and a power consuming device (also not shown for reasons of clarity). Housing 12 may also include a coolant charging port and/or a vent port.

Transformer 16 includes a transformer core 20, a bobbin 22 (shown in FIG. 3), and windings 24. Bobbin 22 is disposed over an external surface of core 20 and is formed from an electrically insulating material. Windings 24 are formed from an electrically conductive material, such as individual turns of copper wire, and are wrapped about bobbin 22. Transformer 16 may be an autotransformer. In embodiments, transformer 16 may be an autotransformer rectifier circuit such as described in commonly assigned U.S. Patent Application Publication No. 2014/0091891 A1 to Metzler et al., the contents of which are incorporated herein by reference.

Condenser 14 includes a thermally conductive material such as aluminum or any other suitable material and includes fins 32 and a base 34. Fins 32 extend towards transformer 16, and in the orientation illustrated in FIG. 1 extend downward relative to gravity from base 34, into housing interior 18, and towards transformer 16. Base 34 may be connected directly to housing 12 such that it forms a portion of housing 12. Base 34 may also couple to a lid 36 of housing 12, lid 36 in turn being sealably coupled to housing 12.

A coolant reservoir 38 is disposed within housing interior 18. Transformer 16 is fixed within housing 12 and is immersed within coolant reservoir 38. This places windings 24 within the coolant forming coolant reservoir 38 and below as surface 40 of coolant reservoir 38. Immersing transformer 16 within coolant reservoir allows the coolant forming coolant reservoir 38 to infiltrate into spaces disposed about individual turns of windings 24. This enables coolant from coolant reservoir 38 to access gaps defined between adjacent windings.

As illustrated in the exemplary embodiment shown in FIG. 1, an inner winding turn and an outer winding turn extend about core 20. The inner winding turn and core define therebetween a first gap, the inner winding and outer winding define therebetween a second winding gap, and the outer winding and housing interior surface define therebetween a third gap. In embodiments, coolant may occupy the first and third gaps to remove heat from the windings. In certain embodiments, coolant may also occupy the second gap to remove heat from the windings. This reduces thermal resistance by directly removing heat from windings that otherwise would have to traverse the winding to reach a winding surface in contact with coolant. As will be appreciated, transformer 16 can have any number of winding turns as suitable for a given application.

Surface 40 of coolant reservoir 38 and condenser base 34 define therebetween an ullage space 42. In the orientation illustrated in FIG. 1, fins 32 of condenser 14 extend from base 34, through ullage space 42, and into coolant reservoir 38. In embodiments, fins 32 are disposed above coolant reservoir 38 such that tips of respective fins do not extend into coolant reservoir 38. In certain embodiments, fins 32 extend into coolant reservoir 38 for a predetermined distance. As will be appreciated, ullage space 42 can shift depending upon the orientation of transformer assembly 10 relative to gravity.

Current flow through transformer windings typically heats the windings. The peak temperature that windings experience is generally a function of the conduction size (e.g. wire gauge), conductor material, and current flow. Conventional transformers are therefore assigned ratings influenced by the peak temperature that the transformer can experience and remain reliable.

With continuing reference to FIG. 1, immersing windings 24 within coolant reservoir 38 increases rating of transformer 16 for a given wire size by providing coolant directly to winding portions that could otherwise be difficult to cool. For example, immersion within coolant reservoir 38 allows the coolant to infiltrate gaps between the windings and bobbin that otherwise would be occupied by an insulator like air.

It is contemplated that coolant reservoir 38 include a coolant that is a dielectric material. The dielectric material may be a fluorinated organic compound, such as perfluorohexane or tetradecafluorohexane. One such suitable coolant is FC-72, sold under the trade name of Fluorinert®, available from the 3M Company of St. Paul, Minn. In embodiments, the dielectric material is selected such that the coolant within coolant reservoir 38 vaporizes at a temperature that is below a predetermined temperature limit of windings 24 within a predetermined pressure range that housing 12 maintains relative to the external environment.

Vaporization of the coolant within coolant reservoir 38 does two things. First, the enthalpy of the phase change of coolant within coolant reservoir 38 cools windings 24 by receiving heat from windings 24. Second, vaporizing the coolant causes the bubbles 56 to develop within coolant reservoir 38. The bubbles form liquid and gaseous phase mixture within coolant reservoir 38 of different densities. The difference between the density of the liquid coolant and gaseous coolant within bubbles 56 causes the vaporized coolant to rise towards condenser 14 and be replaced by liquid phase coolant, establishing passive convective flows within housing interior 18.

Figure 2:
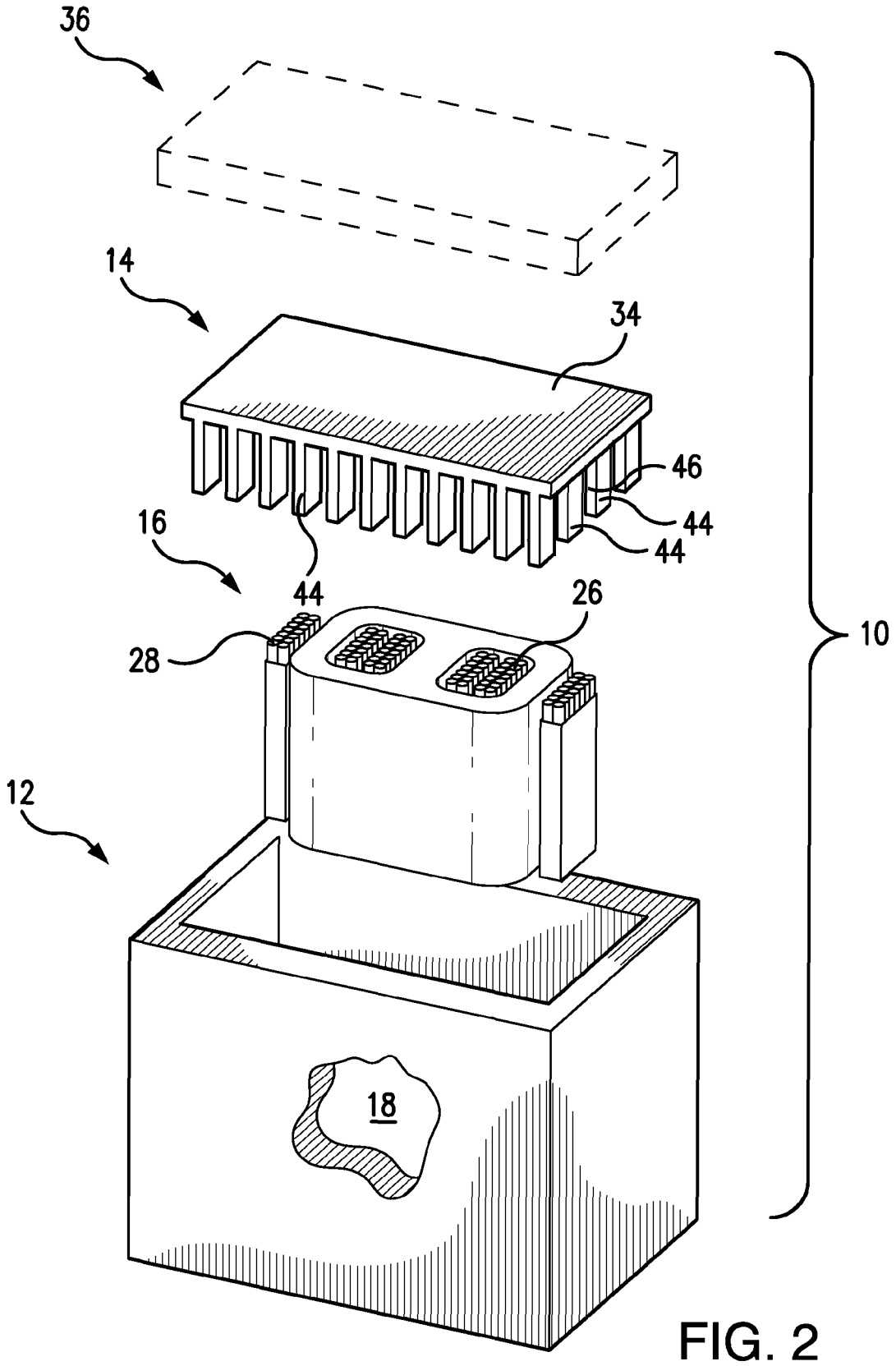
FIG. 2 is a schematic exploded perspective view of the transformer assembly of FIG. 1, showing the heat sink and transformer windings.

With reference to FIG. 2, transformer assembly 10 is shown in an exploded view. As illustrated, condenser 14 includes a plurality of pin fins 44. Pin fins 44 extend downward from base 34 and define therebetween a plurality of lateral passages 46. Lateral passages 46 allow bubbles 56 containing vaporized coolant issuing from coolant reservoir 38 (shown in FIG. 1) to distribute across surfaces of condenser 14 within ullage space 42. This improves heat transfer from the vaporized coolant into condenser 14 by distributing vaporized coolant across surfaces of condenser 14.

Figure 3:
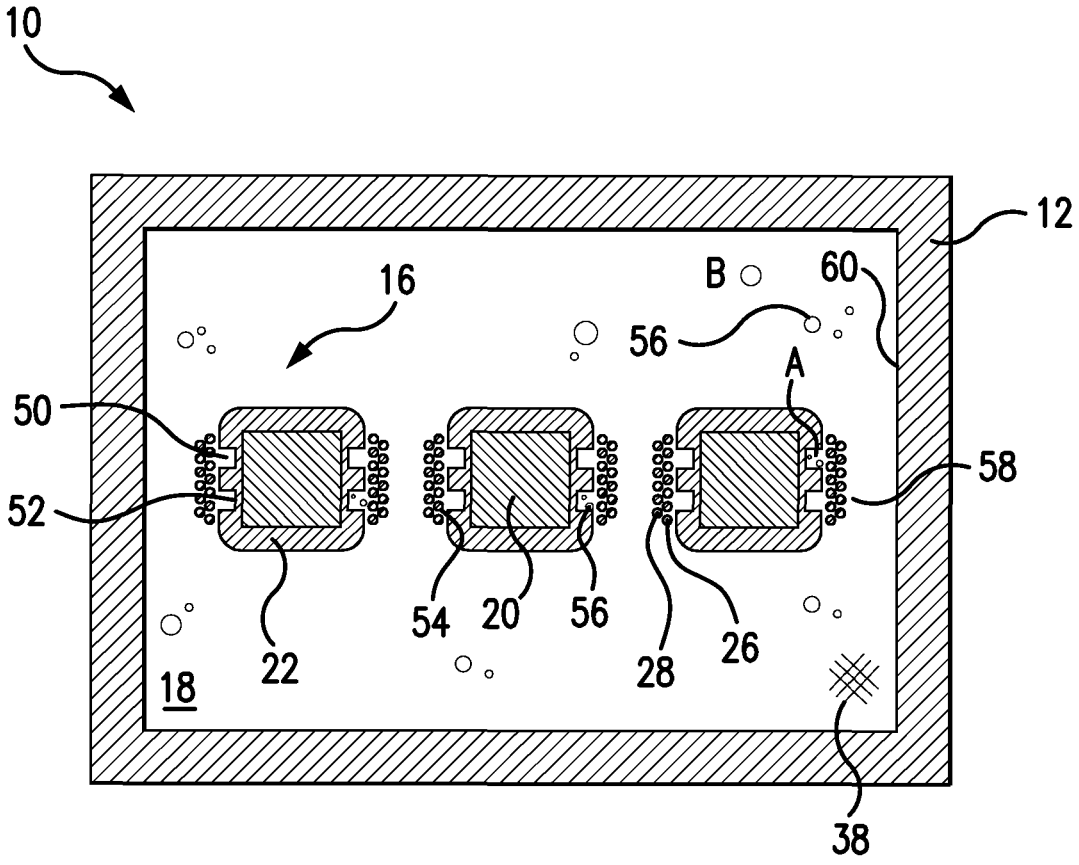
FIG. 3 is a schematic cross-sectional plan view of the transformer assembly of FIG. 1, showing a slotted bobbin defining coolant channels between the between inner windings and the bobbin to coolant the inner windings.

With reference to FIG. 3, transformer assembly 10 according to an embodiment is shown in a cross-sectional plan view. Transformer assembly 10 includes a transformer 16 seated within housing interior 18 and immersed within coolant reservoir 38. Transformer 16 includes a core 20, a slotted bobbin 22 defining a plurality of slots 50 disposed about core 20, inner winding 26 wrapped about bobbin 22, and outer winding 28.

Slots 50 define vertical slots relative to gravity that extend along a height of bobbin 22, i.e., out of the drawing sheet relative to FIG. 3. Slots 50 include slot surfaces 52 that, in conjunction with core-facing surfaces 54 of inner winding 26, define a first coolant channel A.

First coolant channel A is proximate to inner winding 26 and provides, via convection, liquid coolant to inner winding 26. Coolant provided to first coolant channel A removes heat resultant from electrical current flowing through inner winding 26 by undergoing a first phase change, vaporizing, and forming bubbles 56 that travel to condenser 14 (shown in FIG. 2). An outer surface 58 of outer winding 28 and inner surface 60 of housing 12 bound a second coolant channel B. Second coolant channel B is proximate outer winding 28 and also provides, via convection, liquid coolant to outer winding 28. Coolant provided to second coolant channel B removes heat resultant from electrical current flowing through outer winding 28 by undergoing a first phase change, vaporizing, and forming bubbles 56 that travel to condenser 14 (shown in FIG. 2). As such, the need for heat to conduct from inner winding 26 to either outer winding 28 and/or core 20 is reduced because the coolant has access to inner winding 26.

Coolant within coolant reservoir 38 undergoes a first phase change with first coolant channel A. In this respect, coolant adjacent to inner winding 26 undergoes localized boiling (i.e. vaporization) at locations within first coolant channel A proximate to core-facing surface of inner winding 26. Similarly, coolant adjacent to outer winding 28 also undergoes localized boiling (vaporization) at locations within second channel B proximate to housing-facing surface 58 of outer winding 28. The localized boiling occurs at regions of high loss (e.g. the transformer windings) for a given power level of transformer 16 due to the resistive heating of the windings and heat transfer characteristics of the windings. Vaporization of coolant within coolant reservoir 38 causes the vaporized coolant to form bubbles 56. Bubbles 56 convey the vaporized coolant upwards through first channel A and towards condenser 14 (shown in FIG. 1).

Windings 24 may be oriented vertically relative to gravity within housing 18. Adjacent turns of windings 24 define upriser conduits therebetween that facilitate upward movement of coolant through the windings and transformer assembly. In embodiments, the upriser conduits are sized such that little (if any) resistance opposes upward coolant flow resistance, thereby inhibiting reflux or downwards flow in the uprisers. Separate downcomer passages defined between the surfaces of windings facing the interior surface of housing 18 cooperate with the upriser passages to circulate fluid within housing 18. This can produce a closed loop thermosiphon effect wherein heat is exchanged passively, through natural convection, and without the use of a pump.

With continuing reference to FIG. 1, bubbles 56 bearing vaporized coolant move through coolant reservoir 38, traverses coolant surface 40, and enters ullage space 42. Upon entering ullage space 42, the vaporized coolant comes into contact with condenser 14. Contact with condenser 14 allows heat transfer from the vaporized coolant to condenser 14, enough of which causes the vaporized coolant to undergo a second phase change by condensing into a liquid once sufficient heat is transferred to condenser 14. The condensed coolant thereafter returns to the coolant reservoir by the force of gravity along fins 32 of condenser 14.

Condenser 14 transfers heat received from the vaporized coolant to the environment external to transformer assembly 10. In embodiments where condenser 14 forms a portion of housing 12, heat transfers directly from transformer assembly 10 to the external environment. In embodiments having condenser 14 coupled to a lid 36, heat may transfer from condenser 14 and through lid 36 prior to rejection to the external environment.

Some power converters include overlapping layers of electrically conductive windings. These windings can be a significant source of heat. Inner windings can be difficult to cool via conduction to a solid medium due to relatively large portions of the conductor surface area being covered by additional winding turns, and therefore not directly accessible to coolant. In some converters, relatively large thermal resistance can be imposed on the inner windings, potentially limiting the power rating of the transformer and/or current flow through the windings.

In embodiments described herein, a transformer is fully immersed in a coolant including dielectric material within a sealed housing. The sealed housing forms a sealed pressure vessel that enables the coolant to vaporize at a relatively low temperature corresponding with a temperature limit of the transformer windings. Since the coolant is able to infiltrate into gaps in and around the windings, the coolant is able to transfer heat from localized hot spots on the windings that otherwise could heat unevenly due to the thermal resistance posed by surrounding structure. The heat transfer at such locations, e.g. hot spots, is enhanced by the enthalpy of the phase change undergone by the coolant proximate to the locations, promoting more uniform winding heating for a given current load.

Figure 4:
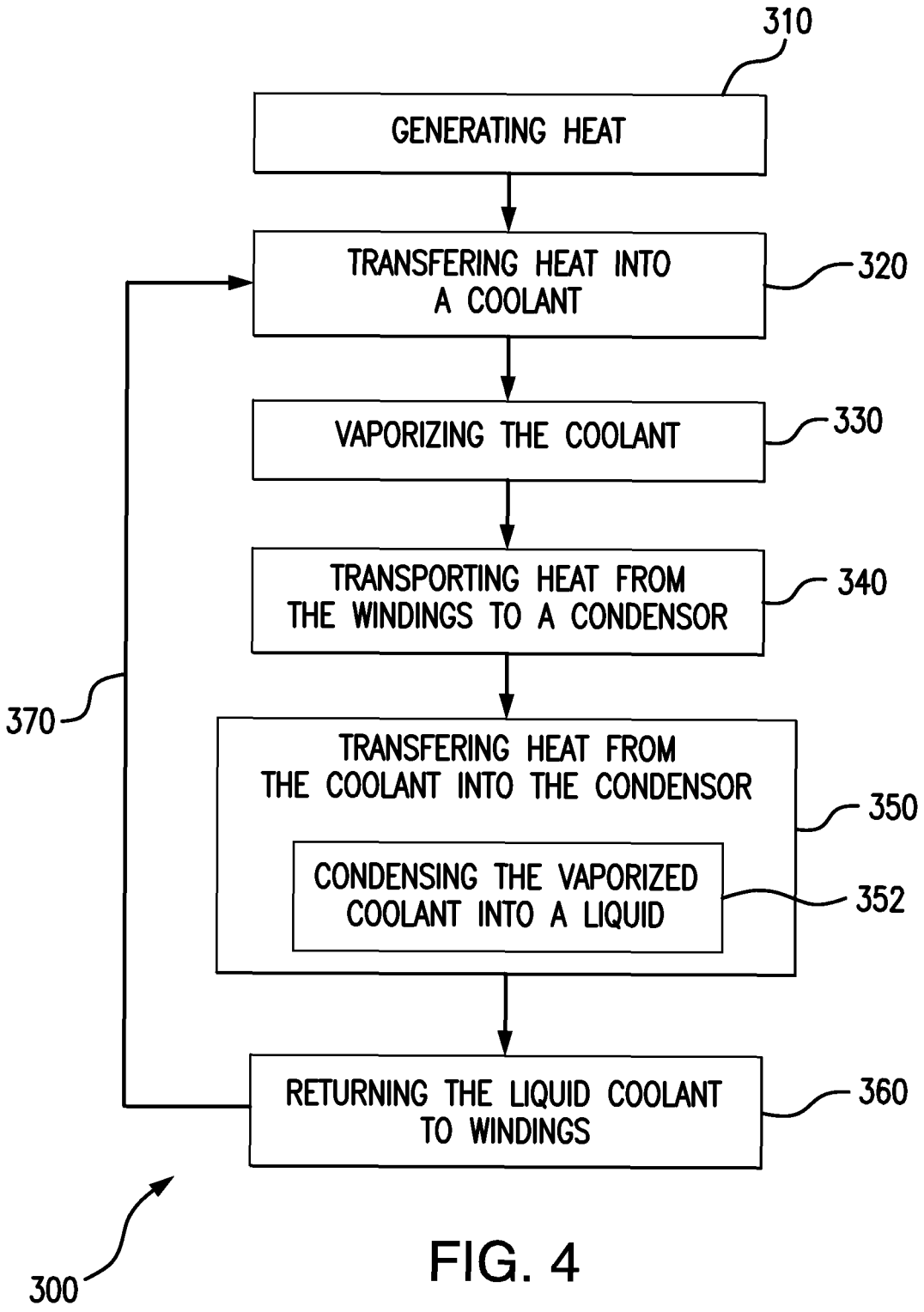
FIG. 4 schematically shows a method for cooling a transformer immersed within a coolant reservoir within a sealed transformer housing.

With reference to FIG. 4, a method 300 of cooling a transformer is shown. Method 300 includes generating heat, such as through resistive heating of windings 24, as shown with box 310. Method 300 also includes transferring heat into coolant surrounding the windings, such as through conduction from the windings into coolant disposed within coolant reservoir 38, as shown with box 320. Method 300 further includes transporting the heat from the windings to a condenser disposed over the windings, e.g. condenser 34, using convection, as shown with box 340. It is contemplated that transferring heat from the windings may also include vaporizing coolant located in proximity to the windings, as shown with box 330. The vaporized coolant may be of lower density than the surrounding coolant, enhancing heat flow from the transformer windings to the housing.

Once the vaporized coolant arrives at the condenser the vaporized coolant comes into contact with the condenser, conducts heat into the condenser, as shown with box 350. The condenser conducts the heat out of the transformer housing and condenses the vaporized coolant into liquid coolant, as shown with box 352. Once condensed, the coolant returns to the coolant reservoir as liquid and recirculates to the windings to replace coolant mobilized by vaporization occurring at the windings, as shown with box 360. Heat transfer into the coolant, vaporization, heat transport, heat transfer out of the coolant, and condensing the coolant may be done in a closed loop cycle based on the duty cycle of a transformer immersed within the coolant, as shown with arrow 370.

In certain embodiments, vaporized coolant condenses on the surface of a condenser disposed above an ullage space defined within the housing interior. Once condensed, the fluid flows down the condenser fins and into the coolant reservoir via natural convection and without the aid of a mechanical flow device. In contemplated exemplary embodiments, transformer assemblies described above can reduce the temperature rise between inner windings and the core for a given power level. This allows a transformer to have a greater power rating than a conventional transformer for a given size or weight. In certain embodiments, the coolant may provide additional thermal mass to accommodate intervals of transformer operation over the steady state rated capability of the transformer.

The methods and systems of the present disclosure, as described above and shown in the drawings, provide for power converters with superior properties including improved heat rejection. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A transformer assembly, comprising:

a housing with a sealed housing interior;

a transformer disposed within the housing interior and having:

a magnetic core;

a slotted bobbin seated about the magnetic core and having slot surfaces; and windings wrapped about the core and having core-facing surfaces, wherein the winding core-facing surfaces and bobbin slot surfaces are spaced apart by a coolant channel; and a condenser mounted to the housing in fluid communication with the housing interior, wherein the coolant channel extends along a height of the bobbin between the windings and the condenser to convey coolant of a first phase to the condenser and receive coolant of a second phase from the condenser.

2. The transformer assembly as recited in claim 1, wherein the coolant channel extends vertically relative to gravity opposite the winding core-facing surfaces.

3. The transformer assembly as recited in claim 1, wherein the coolant channel is first coolant channel, wherein an interior surface of the housing opposite the an outer winding surface bounds a second coolant passage, wherein the second coolant passage is a downcomer passage.

4. The transformer assembly as recited in claim 1, further including a coolant disposed within the housing interior and having a boiling temperature that is below a predetermined winding operating temperature.

5. The transformer assembly as recited in claim 4, wherein a surface of the coolant is separated from the condenser by an ullage space, wherein the windings are immersed in the coolant below the ullage space.

6. The transformer assembly as recited in claim 4, wherein the coolant has a boiling temperature of about 56 degrees Celsius at a pressure of 1 atmosphere.

7. The transformer assembly as recited in claim 4, wherein the coolant includes a perfluorohexane-based material.

8. The transformer assembly as recited in claim 1, wherein the condenser includes a base and fins, wherein the fins extend from the base and towards the windings.

9. The transformer assembly as recited in claim 8, wherein the fins extend through an ullage space and into a coolant pool disposed within the housing interior.

10. The transformer assembly as recited in claim 8, wherein the fins include pin fins that define a fluid channel therebetween, the fluid channel extending laterally through the ullage space.

11. The transformer assembly as recited in claim 1, wherein a width of the bobbin is arranged between the core and the windings.

12. The transformer assembly as recited in claim 11, wherein the bobbin defines at least one slot containing the coolant channel and extending from a side of the windings opposite the condenser and towards the condenser along the height of the bobbin.

13. The transformer assembly as recited in claim 1, wherein the windings are inner windings, and further including outer windings wound about the inner windings.

14. The transformer assembly as recited in claim 13, wherein the coolant channel is an inner coolant channel and further including an outer coolant channel extending between a side of the outer windings opposite the condenser and towards the condenser, the inner coolant channel being bounded by a core-facing surface of the core, the outer coolant channel being bounded by a housing-facing surface of the outer windings.

15. The transformer assembly as recited in claim 1, wherein the windings include inner windings wrapped about the bobbin and outer windings wrapped about the inner windings, wherein the outer windings housing interior define between one another a downcomer passage, wherein the outer windings and inner windings defined therebetween an upriser passage.

* * * * *